United States Patent [19]

Frank

[11] Patent Number: 5,040,254

[45] Date of Patent: Aug. 20, 1991

[54] INFANT CRIB

[76] Inventor: Anthony J. Frank, 2 White Oak Dr., Ocean View, N.J. 08230

[21] Appl. No.: 644,140

[22] Filed: Jan. 22, 1991

[51] Int. Cl.[5] ..... A47D 7/00

[52] U.S. Cl. ..... 5/99.1; 5/93.1; 5/100

[58] Field of Search ..... 5/93.1, 99.1, 100, 174

[56] References Cited

U.S. PATENT DOCUMENTS

| | | | |
|---|---|---|---|
| 198,155 | 12/1877 | Reed | 5/100 X |
| 526,081 | 9/1894 | Mackie | 5/99.1 |
| 1,135,022 | 4/1915 | Hummel | 5/99.1 |
| 2,247,598 | 7/1941 | Bohlen | 5/99.1 X |
| 2,628,370 | 2/1953 | Hoke | 5/99.1 |
| 3,656,195 | 4/1972 | Leahey | 5/99.1 |
| 3,796,342 | 3/1974 | Sanders et al. . | |
| 3,879,773 | 4/1975 | Spencer . | |
| 3,896,513 | 7/1975 | Boucher et al. . | |
| 3,979,783 | 9/1976 | Spencer . | |
| 4,097,942 | 7/1978 | Bridger . | |
| 4,250,580 | 2/1981 | Eichenauer . | |
| 4,692,953 | 9/1987 | Fetters . | |
| 4,693,387 | 9/1987 | Stonier . | |
| 4,765,004 | 8/1988 | Kessel . | |
| 4,798,304 | 1/1989 | Radar . | |

*Primary Examiner*—Michael F. Trettel
*Attorney, Agent, or Firm*—Allan Jacobson

[57] ABSTRACT

An improved infant crib includes a top frame, and a base panel. The crib side walls each comprise a pair of hinged side panels which are hinged to each other, to the base panel, and to the top frame so as to collapse inwardly drawing the base and top frame together. The crib includes two end panels which are hinged to the top frame so as to rotate inwardly from a vertical position to a horizontal position on the same plane as the top frame. When the end panels are in a vertical position, the side panels are locked in place forming a rigid structure. Extendable legs slide downward from channels within the end panels to support the crib above the floor. The resulting structure is strong when assembled, yet is easily and quickly collapsible to form a compact package suitable for stacking storage.

13 Claims, 10 Drawing Sheets

INFANT CRIB

FIELD OF THE INVENTION

This invention relates to the field of infant cribs, and more particularly this invention relates to the field of portable infant cribs which are collapsible into a compact package suitable for stacking storage.

BACKGROUND OF THE INVENTION

Infant cribs which disassemble for storage are well known. For example, see U.S. Pat. Nos. 3,879,773 and 3,979,783 to Spencer, U.S. Pat. No. 3,896,513 to Boucher et al, or U.S. Pat. No. 4,765,004 to Kessel. Collapsible and portable travel cribs are also well known from U.S. Pat. No. 4,097,942 to Bridger, U.S. Pat. No. 4,250,580 to Eichenauer, or U.S. Pat. No. 4,692,953 to Fetters.

Prior art infant cribs are often made of wood which have hinged joints that come apart from the action of children rocking back and forth. The screws pull out of the wood frame resulting in structural failure as well as presenting a danger of pinched fingers. Glued joints where the rungs connect to the top and bottom rails, also are weakened by the rocking action of children. Even if these joints are secured by a pin or nail, they can still come apart causing structural failure and possible harm to the child. Conventional cribs also typically employ caster wheels which either break through the side of the leg or fall out and are often lost.

In a conventional crib, bottom panels start to sag over time, from both physical stress and accumulated moisture. Eventually the bottom panel falls through, dropping the child to the floor.

Also, prior art cribs are often inconvenient to disassemble or adjust. For example, in some designs, to extend the legs, one must unbolt at least 4 of the 8 bolts that hold the legs in place, and relocate these bolts into different holes once the legs have been extended. Often the leg bolts are misplaced. The procedure is time consuming and tools are sometimes required. Furthermore, the mattress pad typically must be removed in order to disassemble and collapse the crib, and in most cases the mattress must be carried and stored separately.

Also, a conventional foldable crib and mattress cannot be easily cleaned. Furthermore, conventional foldable cribs do not stack well, and cannot be stacked more than 6 or 7 units high without possible damage. Typically, prior art cribs are stored side by side and tend to snag on one another when one of the cribs is removed.

SUMMARY OF THE INVENTION

The present invention is embodied in an improved infant crib comprising a base panel on which a crib mattress is placed. A rigid open top frame forms the top rails of the crib. The crib includes two side walls, each comprising a pair of hinged side panels which are hinged to each other, to the base panel and to the top frame so as to collapse inwardly drawing the base panel and top frame together.

The crib end walls each comprise an end panel hinged to the respective ends of the top frame so as to rotate inwardly from a vertical position to a horizontal position on the same plane as the top frame. When rotated to the vertical position, the end panels lock the hinged side panels into place forming a rigid box-like structure. Extendable and retractable legs support the crib structure above the floor.

In one embodiment, the base panel contains a recess for receiving the crib mattress. The depth of the recess is approximately equal to the thickness of the mattress in order to avoid crushing the mattress when the crib is in a collapsed position, and to provide for ventilation during storage, as well to provide for access when steam cleaning the crib and mattress assembly.

In another embodiment, the side panels include channels containing retractable legs which which slide within the channels, and may be extended when the crib is in an assembled condition.

Thus, the present invention provides an improved collapsible infant crib which is strong when assembled, having a rugged construction that can withstand the abuse of frequent set up, take down, transport and storage by inexperienced individuals. The base panel can not fall through, because it is hinged through the side walls to the top frame as an integral part of the body of the crib. The end panels and side panels are hinged to a rigid top frame, and when assembled in a vertical position, support each other with no joints to come apart.

In a collapsed condition, the infant crib of the present invention provides a compact unit including legs and mattress pad, which will fold into a flat package which is stackable to a height of 6 feet or more without fear of crushing the cribs at the bottom of the stack.

DETAILED DESCRIPTION

Figure 1:
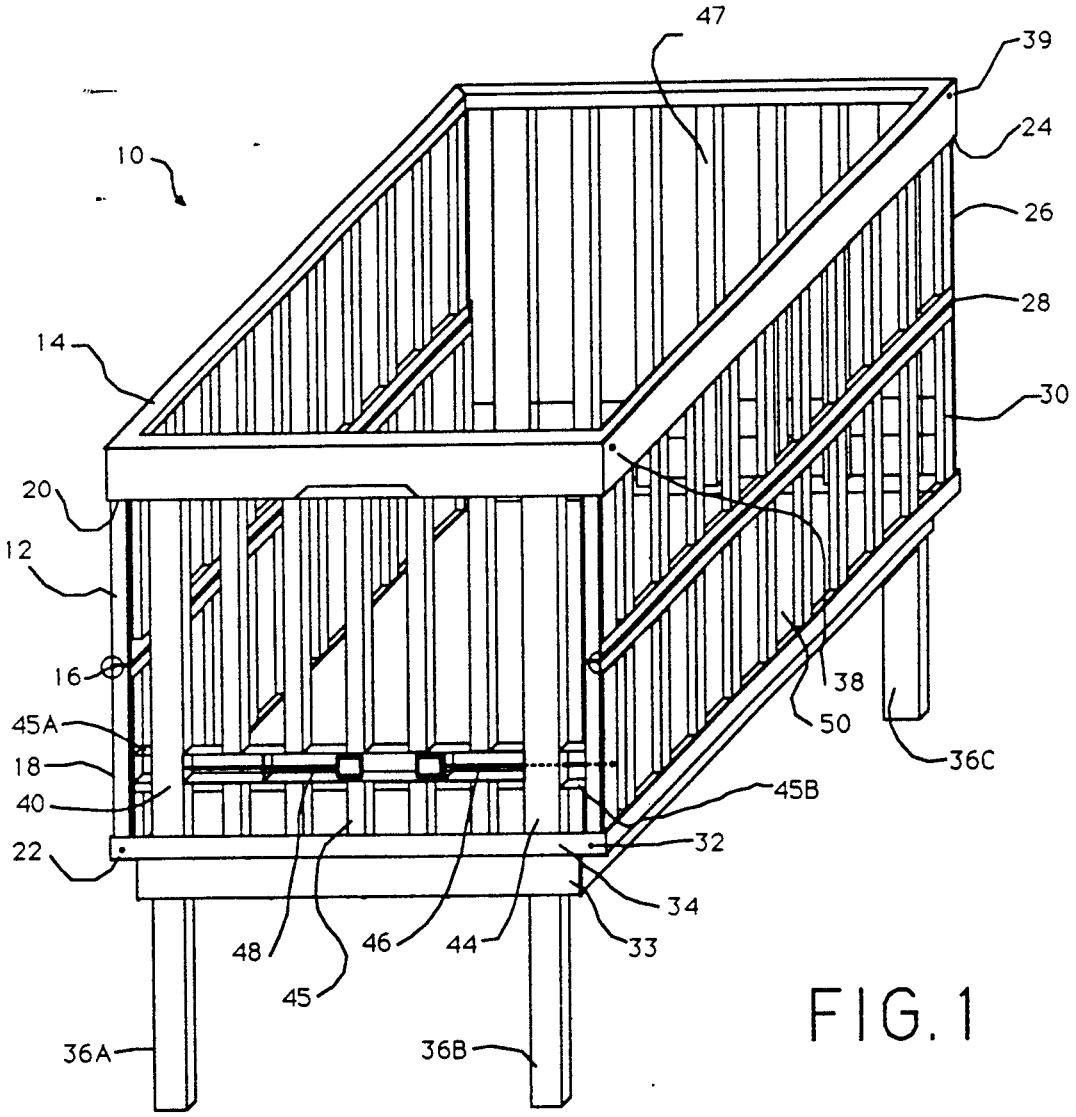
FIG. 1 is an isometric view of an infant crib in accordance with the present invention.

An improved infant crib 10 is shown in FIG. 1. The top rails of each of the sides and ends of infant crib 10 is formed by a rigid open top frame 14. A base panel 34 includes a recess 33 in which the crib mattress 50 is placed. The base panel 34 is connected to the top frame 14 by a pair of crib side walls.

Specifically, one of the two crib side walls comprises a pair of hinged side panels 12 and 18 coupled to each other by a hinge 16. Side panel 12 is connected to the top frame 14 by hinge 20, and side panel 18 is connected to the base panel 34 by a hinge 22. Similarly, the other crib side wall comprises side panel 26 connected to the top frame 14 by hinge 24, and side panel 30 connected to the base panel 34 by a hinge 32.

One of the end walls of the crib is formed by an end panel 45 which is connected to the top frame 14 by a hinge 38. The other end wall of the crib is formed by an end panel 47 connected to the top frame 14 by a hinge 39. In the vertical position as shown in FIG. 1, end panel 45 locks side panels 18 and 30 into place forming a rigid box-like structure through contact with structural portions 45A and 45B of end panel 45. End panel 47 provides similar structural support (not shown) at the other end of the crib. Crib components may be made of injection molded plastic parts, impervious to moisture and teething infants. Also, one piece plastic parts provide side and end panels with integral rungs which cannot come apart like glued joints.

End panels 45 and 47 also include provision for legs 36A, 36B and 36C, and leg 36D (not shown) which legs support the crib structure above the floor. End panel 45 includes channels 40 and 44. Legs 36A and 36B are positioned so as to slide in channels 40 and 44 respectively. Locking pins 48 and 46 are provided within end panel 45 and slide perpendicular to and through the channels 40 and 44. Legs 36A and 36B have holes through which locking pins 48 and 46 can pass. Thus, when the locking pins 48 and 46 are slid away from the center of end panel 45 and through channels 40 and 44, legs 36A and 36B are locked in place and prevented from sliding back into channels 40 and 44. Also, legs 36A and 36B pass through openings in the base panel 34, which locks end panel 45 in place, and prevents rotation of end panel 45 about hinge 38 as long as the legs 36A and 36B are extended.

Figure 2:
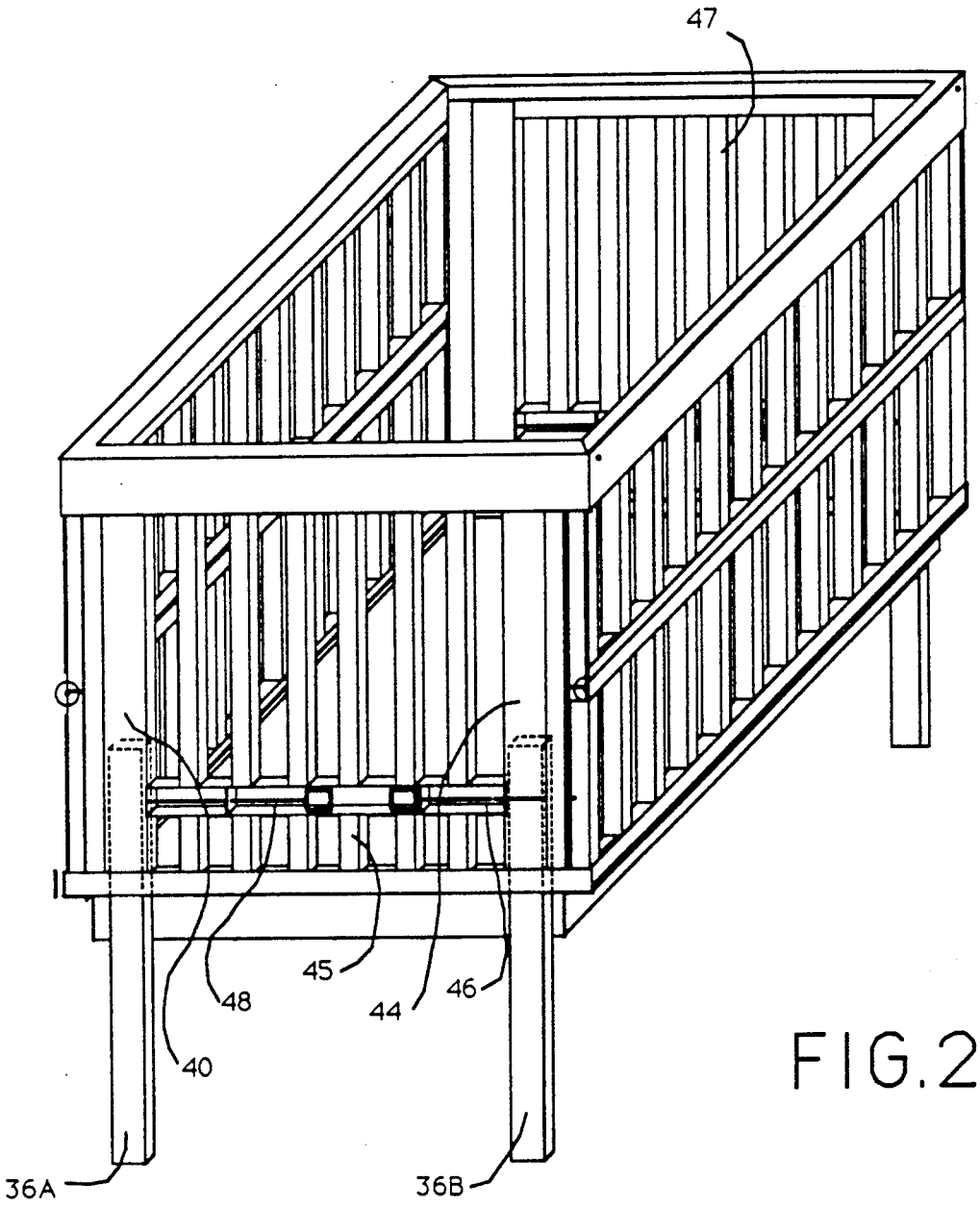
FIG. 2 is an isometric view of an infant crib illustrating the manner in which extendable legs are retractable into the body of the crib, in accordance with the present invention.

In operation, in order to collapse the infant crib in accordance with the present invention, the legs 36A and 36B are first retracted into channels 40 and 44 as illustrated in FIG. 2. First, locking pins 48 and 46 are slid towards the center of end panel 45 and out of the holes through legs 36A and 36B until the locking pins clear the channels 40 and 44. Once the locking pins have been withdrawn, legs 36A and 36B will be able to slide into the channels 40 and 44 of end panel 45.

After the legs 36A and 36B are fully slid into channels 40 and 44, locking pins 48 and 46 are used to lock the retracted legs in place. To secure the legs, locking pins 48 and 46 are slid away from the center of end panel 45, through channels 40 and 44 and through holes provided in legs 36A and 36B, which legs are thereby locked in place within channels 40 and 44. The other two legs 36C and 36D are similarly retraced into corresponding channels with similar locking pins in end panel 47. After the four legs of the crib have been retracted into the channels in the end panels 45 and 47, the crib appears an shown in FIG. 3.

Figure 4:
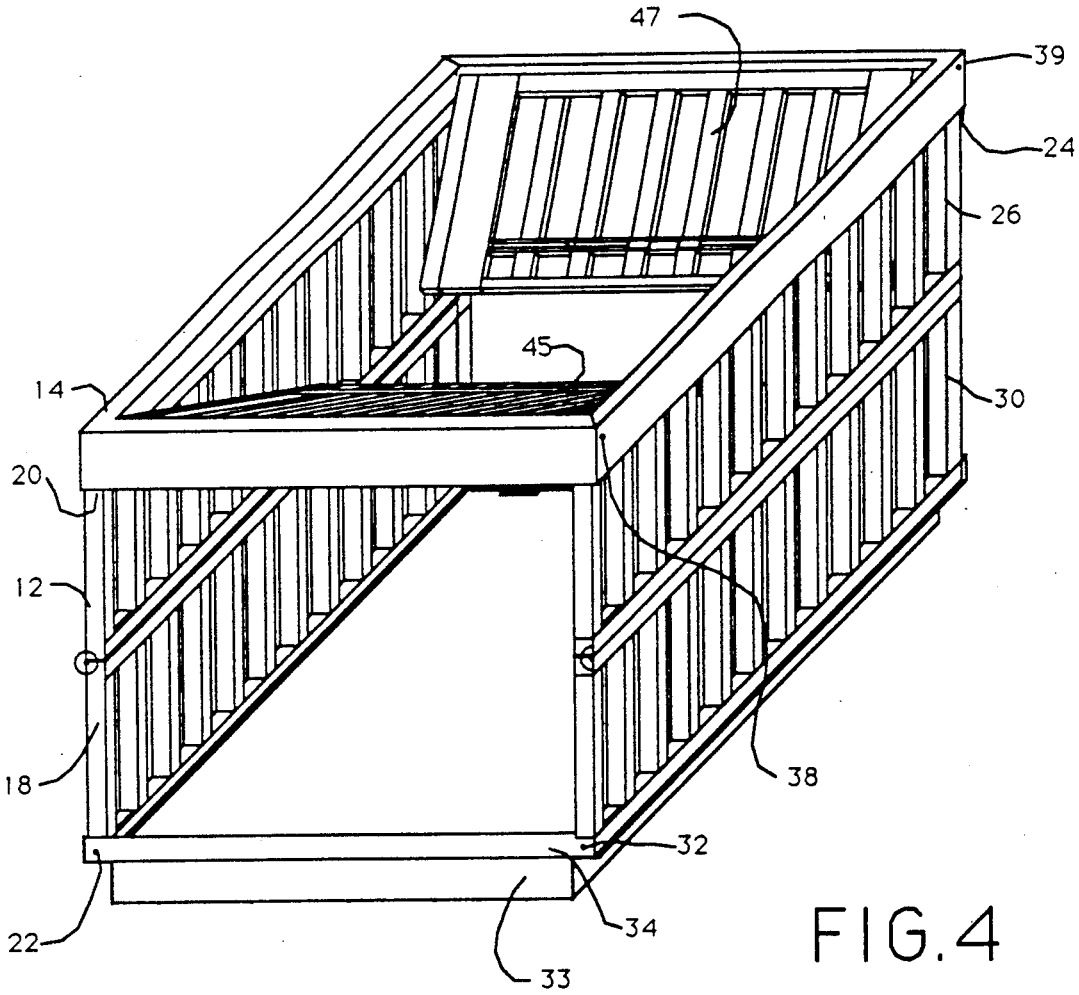
FIGS. 4, 5, and 6 are isometric views illustrating the operation of folding an infant crib at various stages, in accordance with the present invention.
Figure 5:
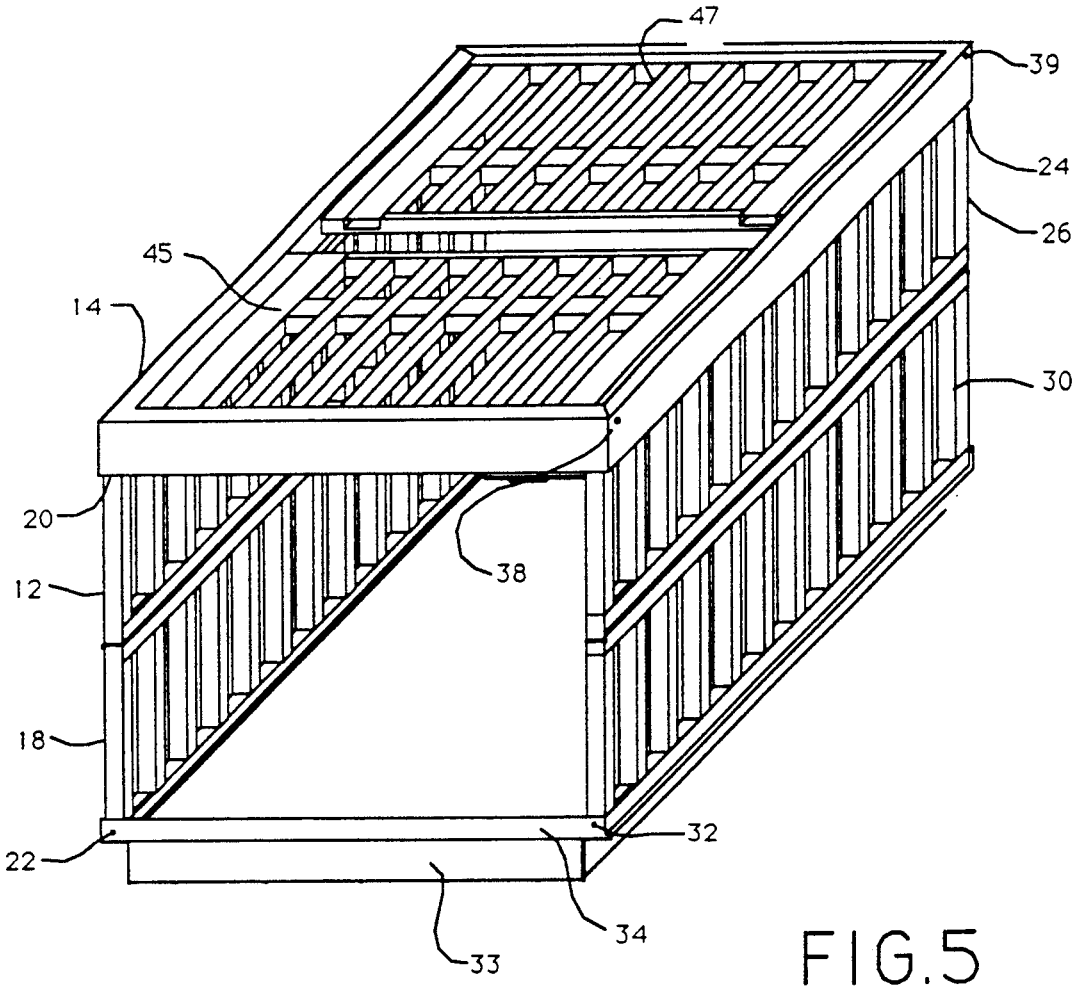
Figure 6:
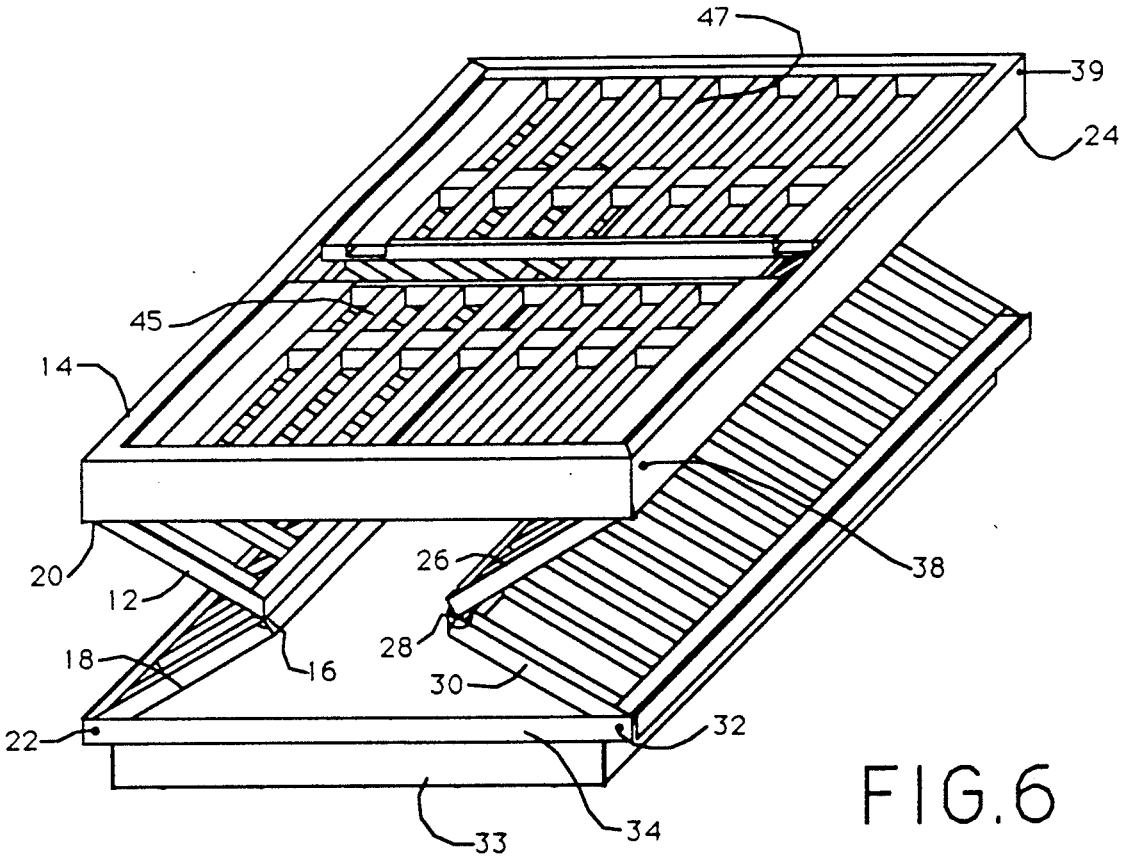

Thereafter, as shown in FIG. 4, end panel 45 rotates inwardly about hinge 38. Also, end panel 47 rotates inwardly about hinge 39. FIG. 5 shows end panels 45 and 47 rotated to a horizontal position in the same plane as the top frame 14. Once the end panels are rotated to a horizontal position, the crib structure loses its rigidity and easily collapses to a folded position. FIG. 6 shows a partially folded condition wherein the hinged side walls of the crib collapse inwardly drawing the base panel 34 and the top frame 14 together.

Figure 7:
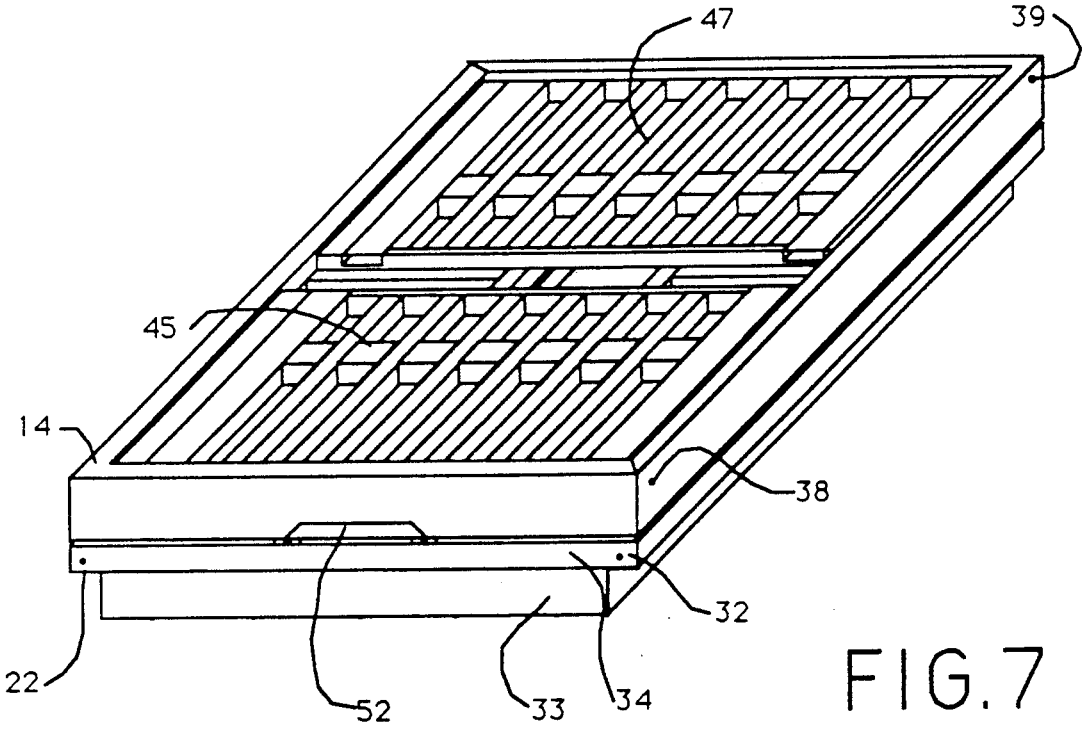
FIG. 7 is an isometric view of an infant crib in a folded condition in accordance with the present invention.

In the folded position, top frame 14 and the base panel 44 form a compact package typically 6 inches high as shown in FIG. 7.

Figure 3:
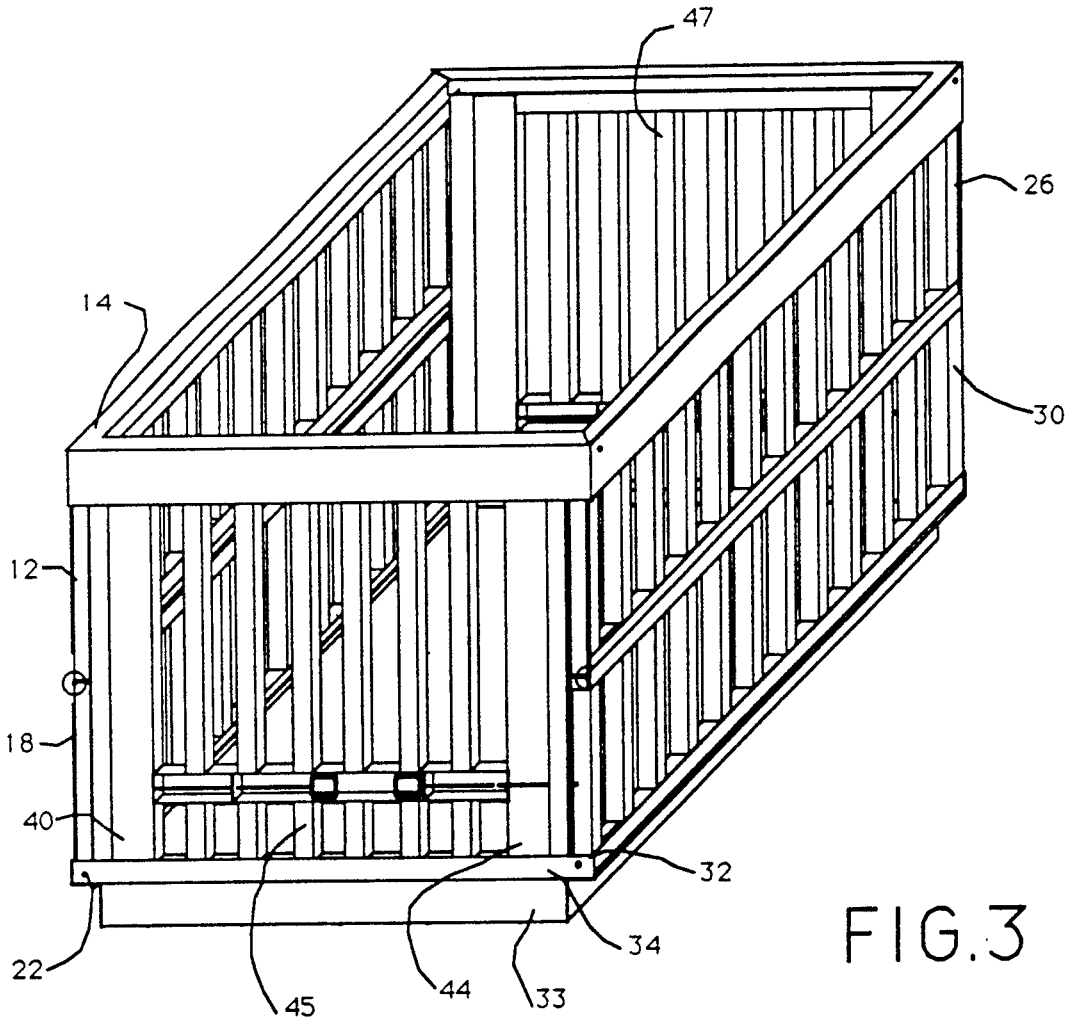
FIG. 3 is an isometric view of an infant crib with the extendable legs retracted into the body of the crib, in accordance with the present invention.

The crib is easily erected from a collapsed condition. First, top frame 14 is grasped, pulling the top frame upward. Recess 52, and a similar recess on the opposite end of top frame 14, is provided for convenience in grasping top frame 14. The weight of the base panel 34 will erect the hinged side panels. Once the side panels are vertical, end panels 45 and 47 will drop into place, locking the side walls into position. The crib may be used as a travel crib without extending the legs, such as shown in FIG. 3.

To extend the legs, locking pins 48 and 46 are slid towards the center of end panel 45 and out of the holes in legs 36A and 36B until the locking pins clear the channels 40 and 44. Once the locking pins have been withdrawn, legs 36A and 36B will be able to slide out of the channels 40 and 44 of end panel 45 to an extended position.

After the legs 36A and 36B are fully extended, locking pins 48 and 46 are used to lock the extended legs in place. To secure the legs, locking pins 48 and 46 are slid away from the center of end panel 45, through channels 40 and 44 and through holes provided in legs 36A and 36B, which legs are thereby locked in place within channels 40 and 44. The other two legs 36C and 36D are similarly extended from corresponding channels with similar locking pins in end panel 47. The smooth bottoms of the plastic legs act in much the same manner as a nylon guide, allowing the crib to be slid along the floor without the use of caster wheels.

Figure 8:
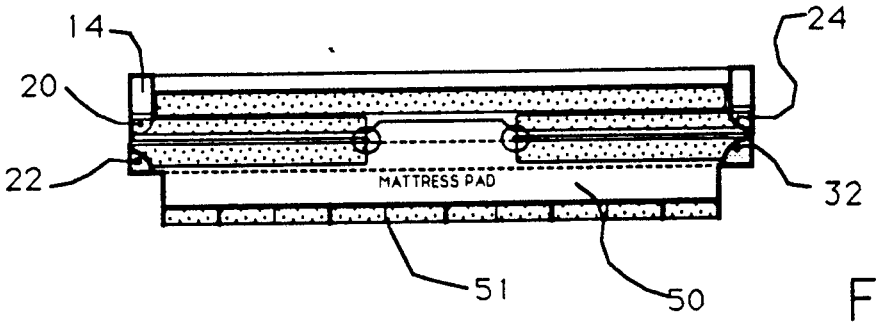
FIG. 8 is a cross sectional view of an infant crib in a folded condition in accordance with the present invention.

FIG. 8 is a cross sectional view of an infant crib in a folded position. When the crib is folded, top frame 14 protects mattress 50 which is resting on the bottom 51 of recess 33 from being crushed. At the same time, mattress 50 receives ventilation to prevent mildew and dissipate odors during storage. Holes may be provided in the bottom 51 of recess 33 to improve ventilation. When folded, the infant crib will stack neatly and compactly to a height of six feet or more without fear of crushing those cribs at the bottom of the stack.

Figure 9:
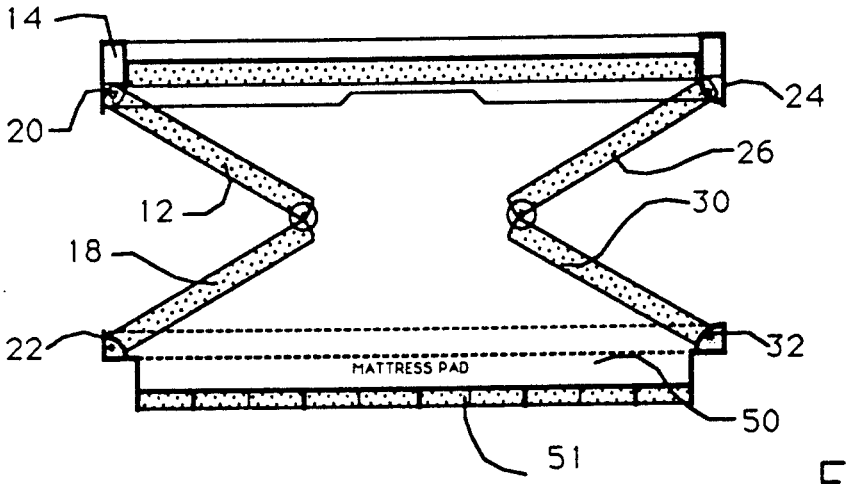
FIG. 9 is a cross sectional view of an infant crib in a partially folded condition in accordance with the present invention.

In a folded condition, access is provided to the mattress pad for steam cleaning. The entire assembly may be steamed cleaned and vacuum wrapped in shrink wrap plastic to form a reusable yet totally sanitary product. In order to improve the thoroughness of steam cleaning, the crib may be steam cleaned in a partially unfolded as shown in FIG. 9.

Figure 10:
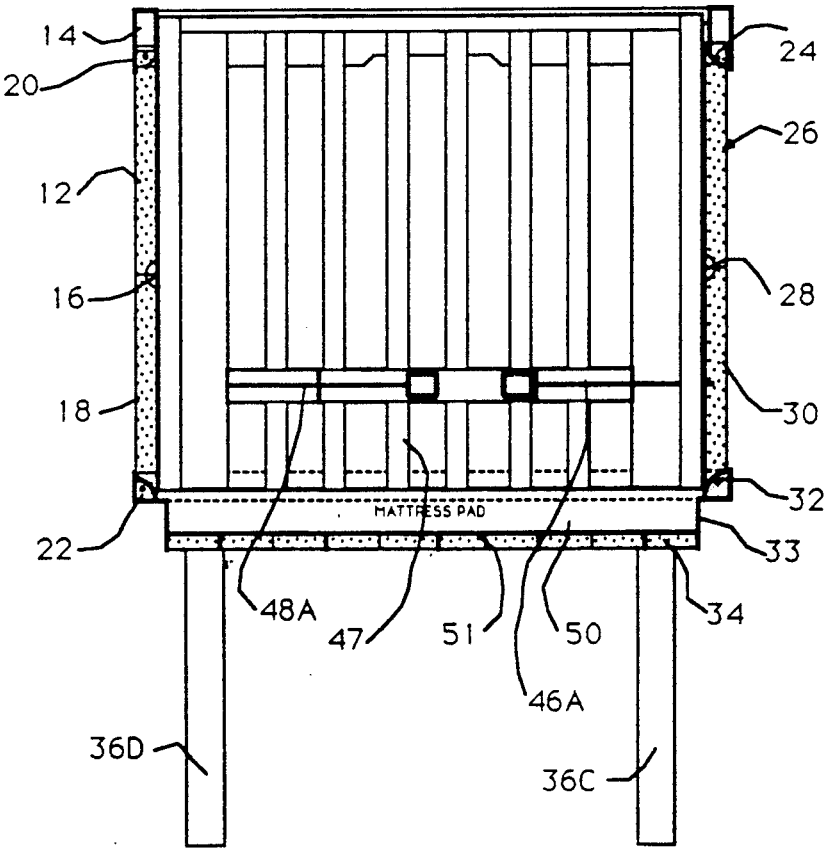
FIG. 10 is a cross sectional view of an assembled infant crib in accordance with the present invention.

FIG. 10 is a cross sectional view of an infant crib in an unfolded condition with the legs extended.

Figure 11:
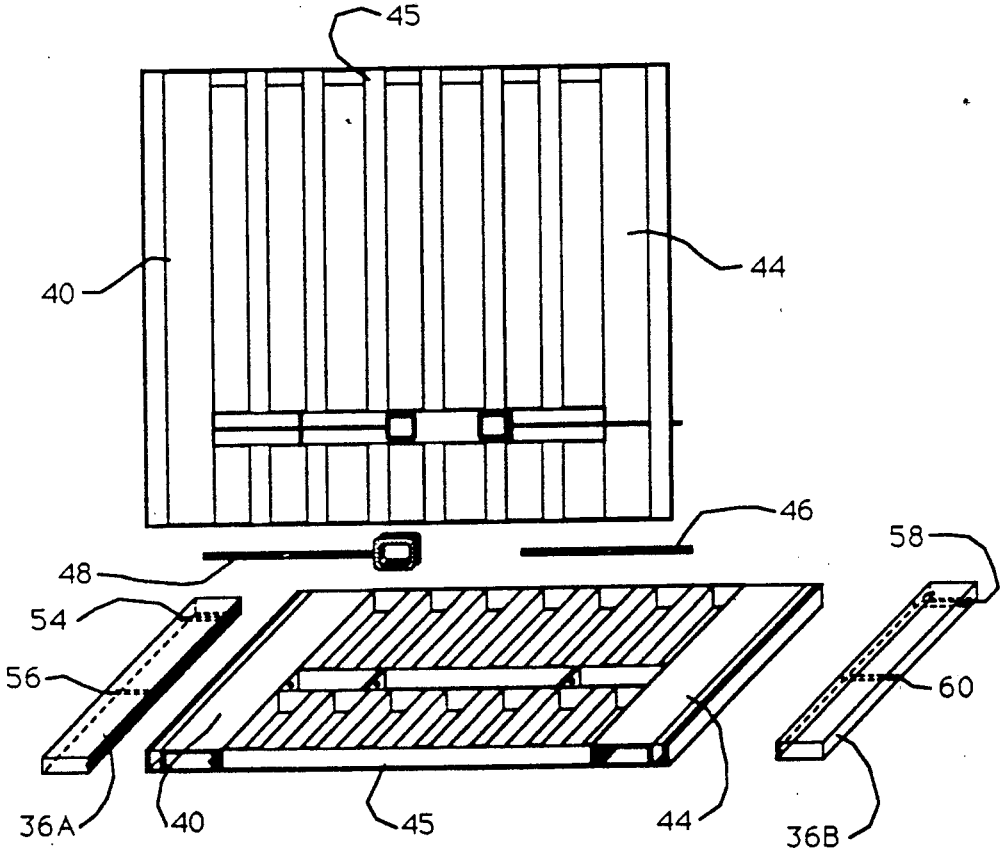
FIG. 11 an isometric view of various parts and subassemblies comprising the end walls of an infant crib in accordance with the present invention.

FIG. 11 shows further details and components the end walls. The main component of an end wall is an end panel 45. One of the crib legs 36A includes a hole 54 therethrough to receive locking pin 48 when the leg 36A is in an extended position, and a hole 56 therethrough to receive locking pin 48 when the leg 36A is in a retracted position. Similarly, another crib leg 36B includes a hole 58 therethrough to receive locking pin 46 when the leg 36B is in an extended position, and a hole 60 therethrough to receive locking pin 46 when the leg 36B is in a retracted position.

The locking pins 48 and 46 which are used to hold the legs in a retracted position during storage, and in an extended position during use are a non-removeable part of the end walls. Therefore, no tools are required to assemble and disassemble the crib. It is particularly convenient that the mattress pad need not be removed in order to fold the crib for storage. Crib end panels and side panels are shown having a conventional rung design, which is familiar to many people. In the alternative, crib end panels and side panels may be economically produced with thin molded sides or with various open patterns.

What is claimed is:

1. An infant crib comprising:
a top frame;
a base panel;
a mattress supported by said base panel;
two side walls each comprising a pair of side panels hinged to each other, to said base panel, and to said top frame so as to collapse inwardly drawing said base panel and said top frame together;
two end walls each comprising an end panel hinged to said top frame so as to rotate inwardly from a vertical position to a horizontal position on substantially the same plane as said top frame; and
a plurality of legs for supporting said infant crib above the floor.

2. An infant crib in accordance with claim 1 further including said legs coupled to said end panels for supporting said infant crib at a given height above the floor.

3. An infant crib in accordance with claim 2 wherein each of said end panels further comprise:
a pair of channels, each of said channels being adapted to receive one of said legs, whereby said legs are retractable and extendable by sliding said legs into said channels respectively.

4. An infant crib in accordance with claim 3 further comprising:
a pair of locking pins;
each of said legs having a pair of holes passing therethrough; and
each of said locking pins being slideably mounted on said end panel so as to pass through one of said holes in said leg whereby said leg is held in a retracted position, and to pass through the other of said holes in said leg whereby said leg is held in an extended position.

5. An infant crib in accordance with claim 1 wherein said crib side panels and said crib end panels each comprise a plurality of rungs.

6. An infant crib in accordance with claim 1 wherein said base panel further includes a recess for receiving said crib mattress.

7. An infant crib comprising:
a top frame;
a base panel, said base panel further including a recess for receiving a crib mattress, the depth of said recess being substantially equal to the height of said mattress;
two side walls each comprising a pair of side panels hinged to each other, to said base panel, and to said top frame so as to collapse inwardly drawing said base panel and said top frame together without crushing said mattress; and
two end walls each comprising an end panel hinged to said top frame so as to rotate inwardly from a vertical position to a horizontal position on substantially the same plane as said top frame.

8. An infant crib in accordance with claim 7 further including legs coupled to said end panels for supporting said infant crib at a given height above the floor.

9. An infant crib in accordance with claim 8 wherein each of said end panels further comprise:
a pair of channels, each of said channels being adapted to receive one of said legs, whereby said legs are retractable and extendable by sliding said legs into said channels respectively.

10. An infant crib in accordance with claim 9 further comprising:
a pair of locking pins;
each of said legs having a pair of holes passing therethrough; and
each of said locking pins being slideably mounted on said end panel so as to pass through one of said holes in said leg whereby said leg is held in a retracted position, and to pass through the other of said holes in said leg whereby said leg is held in an extended position.

11. An infant crib in accordance with claim 7 wherein said crib side panels and said crib end panels each comprise a plurality of rungs.

12. In a collapsible infant crib including a top frame, a base panel, two end walls and two side walls, each of said side walls comprising a pair of side panels which are hinged to each other, to said base panel, and to said top frame, said infant crib further including four legs for supporting said infant crib at a given height, a method for folding said infant crib comprising:
retracting said legs;
rotating said end walls to a horizontal position; and
rotating said side panels to a horizontal position so as to draw said top frame and said base panel together.

13. In an infant crib, wherein said infant crib includes a top frame, a base panel, two end walls and two side walls, each of said side walls comprising a pair of side panels which are hinged to each other, to said base panel, and to said top frame, and said infant crib further includes four legs for supporting said infant crib at a given height, an apparatus for collapsing said infant crib comprising:
means for retracting said legs;
means for rotating said end walls to a horizontal position; and
means for rotating said side panels to a horizontal position so as to draw said top frame and said base panel together.

* * * * *